United States Patent [19]

Borel

[11] Patent Number: 4,515,853

[45] Date of Patent: May 7, 1985

[54] COMPOSITE FABRIC FOR USE AS CLOTHING FOR THE SHEET FORMING SECTION OF A PAPERMAKING MACHINE

[75] Inventor: Georg Borel, Reutlingen, Fed. Rep. of Germany

[73] Assignee: Hermann Wangner GmbH & Co. KG, Reutlinger, Fed. Rep. of Germany

[21] Appl. No.: 571,817

[22] Filed: Jan. 18, 1984

[30] Foreign Application Priority Data

Jan. 20, 1983 [DE] Fed. Rep. of Germany ..... 3301810

[51] Int. Cl.[3] ..... D03D 11/00; D03D 13/00; D21F 7/08

[52] U.S. Cl. ..... 428/257; 139/383 A; 162/348; 162/DIG. 1; 428/258

[58] Field of Search ..... 428/257, 258; 162/348, 162/DIG. 1; 139/383 A

[56] References Cited

U.S. PATENT DOCUMENTS 3,885,603 5/1975 Slaughter ..... 162/DIG. 1

4,356,225 10/1982 Dufour ..... 139/383 A

*Primary Examiner*—James C. Cannon

[57] ABSTRACT

A composite fabric for use as clothing for the sheet forming section of a papermaking machine, which fabric comprises at least two fabric layers (1, 2) interconnected by binder threads (4, 5), and wherein part of the binder threads (4, 5) extend in the warp and weft directions and the threads form an elastic interlayer (3) and wherein each binder thread (4, 5) is interwoven with not more than one of the at least two fabric layers (1, 2).

9 Claims, 12 Drawing Figures

COMPOSITE FABRIC FOR USE AS CLOTHING FOR THE SHEET FORMING SECTION OF A PAPERMAKING MACHINE

BACKGROUND OF THE INVENTION

This invention relates to a composite fabric for use as clothing for the sheet forming section of a papermaking machine and, in particular, to a composite fabric comprising at least two fabric layers interconnected by binder threads Clothing for the sheet forming section of a papermaking machine, so-called sheet forming screens or papermachine screens, should have a smooth top side (paper side) in order to avoid any marks in the paper. On the other hand, the bottom side (backing side) has to be formed so as to impart to the sheet forming screen a long service life. This is required since the use of less expensive and more abrasive filler materials and the increase in operating speed subject the backing side to high wear.

Even in single-layer papermachine screens, the two fabric sides of most types of fabric are different. Thus, the paper side comprised predominantly of warp and weft threads interwoven in monoplanar fashion is smoother and the backing side comprised of weft wire knuckles in the cross fabric direction (weft runners) is rougher.

In the case of double-layer papermachine screens, this difference in the character of the two fabric faces or sides is even more pronounced. With this type of screen, the warp threads are common to both fabric sides. The weft threads, in turn, are divided into two separate weft layers and can be adapted to the requirements of the respective screen surface as regards the material and the thread diameter Morever, each side can be given any desired surface structure independently of that of the other screen side.

However, complete separation of the two screen sides is possible only with so-called two-layer screens. These screens comprise two completely independent fabric layers interconnected by an extra binder thread. Screens of this construction are known from German Offenlegungsschrift Nos. 2,455,184 and 2,455,185. In particular, these references teach circularly woven screens with a binder warp. This implies that in the final screen the two layers are interconnected by transversely extending binder threads.

Interconnection of the two fabric layers by a binder warp, however, has the drawback that during weaving the warp is under tension (weaving tension) so that it influences the structure on the paper side. Furthermore, when a two-layer fabric with a binder warp is woven flat and is made endless by means of a woven seam, the binder warp in the final screen extends in the longitudinal direction. Since the fabric is lengthened during thermosetting in the heating zone, the warp threads are again subject to high working tension. Owing to the fact that the weft threads of the lower layer are substantially thicker and stiffer, the tension of the binder warp affects nearly exclusively the finer threads of the upper layer. Thus, the binder warp pulls the fine weft threads of the upper layer deep into the fabric at the binding points thereby causing non-uniformity in the surface.

The above shortcoming can be remedied to a certain extent by interconnecting the two layers with a binder weft as described in German OS 2,917,694. Although ultimately the two types of fabric are identical—in both fabrics the two layers are interconnected by the additional transverse threads—the manufacture is somewhat easier because in a flat woven and seamed screen, for example, the two layers are interconnected during weaving and during setting by means of a transverse thread (weft thread). However, even when this measure is taken a uniform surface structure of the top layer is not produced, because at the binding points the additionally interwoven binder weft pulls the upper warp deep into the fabric thereby causing undesired depressions at the binding points in the fabric surface.

More particularly, the binder weft thread is placed under tension during weaving when the binder thread, which is initially inserted straight by the shuttle, is crimped upon the change of the harness frame position. The crimped binder weft extends in zig-zag fashion alternately between the upper and lower layers of the composite fabric which are relatively widely spaced apart. Owing to this longer path, the binder thread is already placed in a stretched condition during weaving. Since the lower layer comprises relatively thick, unyielding warp and weft threads, all the tension of the binder weft thread in this case, too, is transmitted to the binding points in the upper layer, because it is solely the structure of the upper layer that is able to yield. This results in a change in the structure of the upper layer at each binding point during the weaving operation.

Furthermore, during heat-setting there is crimp interchange between the warp and the weft wires of the two layers. The warp of the lower layer is stretched and its knuckles are flattened. The space between the lower binding points and the upper fabric layer is enlarged. Since the lower warp is stiff and unyielding, the upper layer is pulled even deeper into the fabric at the binding points.

The influence of temperature during setting releases shrinkage forces inherent in the binder weft thread. These forces act as an additional tensile force affecting the thin upper warp at the binding points and contributing to the non-uniformity of the surface structure.

During the manufcture of some paper types the non-uniformity of the surface at the binding points of the upper screen are of no consequence. However, in certain types of paper highly sensitive to screen marks—such as gravure printing papers, offset and imitation art papers—such sites result in printing imperfections which recur over the entire area of the paper web in uniform distribution corresponding to the weave pattern.

It is therefore a primary object of the present invention to provide a composite fabric for use as clothing for the sheet forming section of a papermaking machine which is comprised of at least two fabric layers interconnected by binder threads and which exhibits improved uniformity of the surface structure on the paper side.

SUMMARY OF THE INVENTION

In accordance with the principles of the present invention, the above and other objectives are realized in a fabric of the aforesaid type by utilizing binder threads part of which extend in the warp direction and part of which extend in the weft direction, to form an elastic interlayer, and by interweaving each binder thread into not more than one of the fabric layers. Therefore, neither during weaving nor during setting of the screen, is the uniformity of the surface structure of the paper side impaired by tension coming from a lower layer.

The interlayer formed from the binder threads thus serves not only to interconnect upper and lower fabric layers, but also to absorb any tension occurring in the course of the manufacture of the composite fabric.

The binder threads of the interlayer since they extend partially in the warp direction and partially in the weft direction and are therefore designated as "binder warp" and "binder weft", respectively. In a preferred embodiment of the invention the binder warp is interwoven with one fabric layer, e.g. the upper layer, in certain intervals, and the binder weft is interwoven with another fabric layer which, in the assumed case, would be the lower fabric layer.

In another embodiment of the invention only the binder warp or the binder weft is interwoven with the upper and partially with the lower fabric layer, while the other binder threads, i.e., the binder weft and the binder warp, respectively, only function as warp or weft threads, respectively, of the interlayer without also being interwoven with one of the two fabric layers.

In each embodiment of the invention, a common principle is that each binder thread is not interwoven with both fabric layers so that the interlayer formed by the binder threads resiliently interconnects the fabric layers.

As usual, the individual layers of the composite fabric may comprise plastic monofilaments, especially polyester threads. The binder threads may also be made of monofilamentary or multifilamentary plastic threads. In particular, the binder threads interwoven with an upper layer are thinnner than the structural warp threads and the weft threads of the upper layer. The structure of the binder threads is capable of absorbing any tension coming from the backing side, i.e. from the lower layer, and can largely prevent such tension from affecting the upper layer.

BRIEF DESCRIPTION OF THE DRAWINGS

The above and other features and aspects of the present invention will become more apparent upon reading the following detailed description in conjunction with the accompanying drawings, in which.

DETAILED DESCRIPTION OF THE INVENTION

Figure 1:
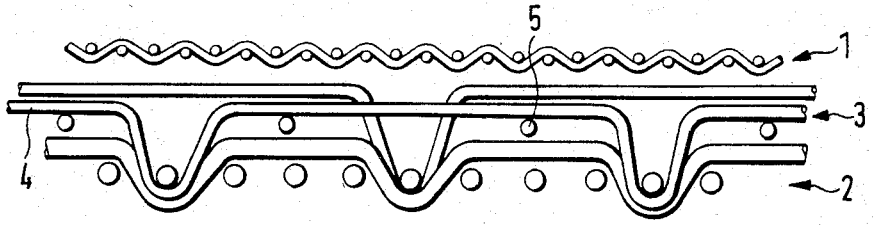
FIGS. 1 and 2 show a composite fabric in which the fabric layers are interconnected by binder threads in accordance with the invention; accordance
Figure 2:
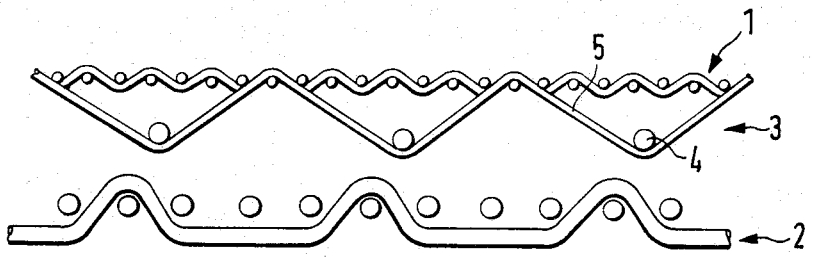

FIG. 1 illustrates a section in the warp direction through a composite fabric comprised of an upper layer 1 and a lower layer 2. The upper layer is woven in plain weave and is made from relatively fine plastic monofilaments. The lower layer 2 comprises substantially coarser plastic monofilaments and is woven in four-harness weave. The number of weft threads and of warp threads per unit of length in the lower layer 2 is only half that in the upper layer 1. FIG. 2 shows the same fabric in a section parallel to the weft direction.

The upper layer 1 and the lower layer 2 are interconnected by binder threads, namely, by a binder warp 4 and a binder weft 5. The binder warp 4 is interwoven with every eighth weft thread in the lower layer 2, i.e., it passes underneath said weft thread. Furthermore, the binder warp 4 is interwoven with the lower layer 2 only after every second binder weft 5. The binder weft 5, in turn, passes over every eighth warp thread of the upper layer 1. Binder warp 4 and binder weft 5 are not mutually interwoven and form an interlayer 3 in the space between the upper layer 1 and the lower layer 2. Owing to the fact that between the binding points with the lower layer 2, the binder warp 4 passes over the binder weft 5, the resulting coherence is similar to that in a woven fabric.

The interlayer 3 is a wide mesh fabric so that it is rather loose. Its density corresponds to one fourth of that of the lower layer 2 and to only one eighth of that of the upper layer 1. Due to this looseness of the interlayer 3, any tension and distortion in the lower layer 2 is not or only slightly transmitted to the upper layer 1. Any tension and distortion in the lower layer 2 can thus be largely absorbed by the interlayer 3 by shifting of the binder warp 4 relative to the binder weft 5 within the loose structure of the interlayer 3. Hence, the interlayer 3 has a high degree of elasticity.

Figure 3:
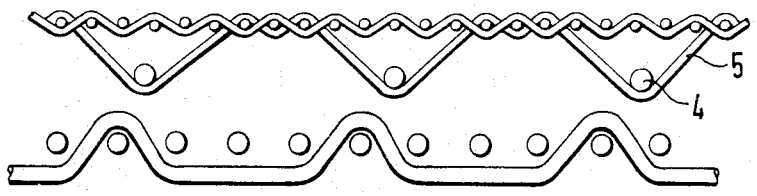
FIG. 3 illustrates a fabric in accordance with the invention in which the binder weft is woven into the upper fabric layer over a length of three warp threads.

FIG. 3. shows a section similar to that of FIG. 2 of an embodiment of the invention, in which the binder weft 5 is woven more firmly into the upper layer 1. In particular, the binder weft 5 is interwoven with three warp threads of the upper layer 1 in that it passes over one warp thread, under the next following, and again over the third warp thread. As a result, any force exerted by the binder weft 5 on the upper layer 1 is distributed over a larger area and in this way has a lesser effect on the uniformity of the surface structure of the upper layer 1.

Figure 4:
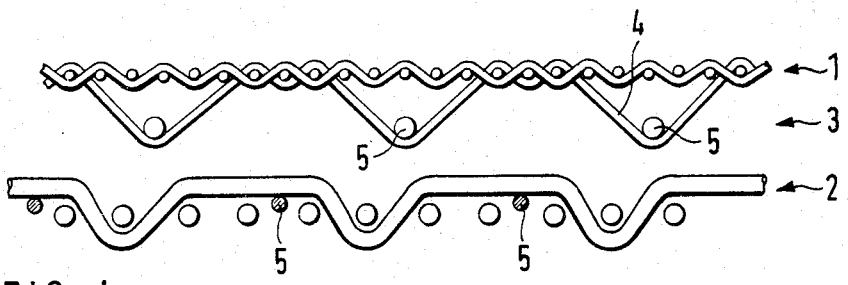
FIGS. 4 to 6 show a composite fabric in which the binder warp is woven exclusively into the upper fabric layer and the binder weft is woven exclusively into the lower fabric layer.
Figure 5:
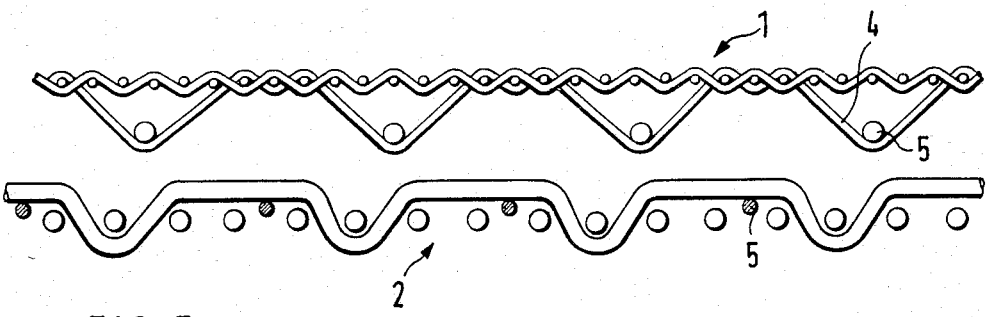
Figure 6:
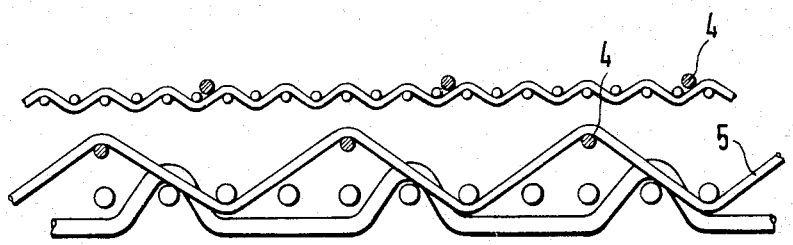

FIGS. 4 to 6 show another embodiment of the invention in which the binder warp 4 is connnected to the upper layer 1 and the binder weft 5 is connected to the lower layer 2. In this case, the density of the interlayer 3 is twice that of the fabric in the example of FIG. 3 described above.

In the FIGS. 4 to 6 embodiment, the binder warp 4 and the binder weft 5 form a fabric because the binder warp 4 alternately passes over and under a binder weft 5, and the binder weft 5, accordingly, alternately passes over and under a binder warp 4. At the points where the binder warp 4 passes over a binder weft 5, the warp 4 is interwoven with the upper layer 1, and at the points where the binder weft 5 passes under a binder warp 4, the weft 5 is accordingly interwoven with the lower layer 2.

FIGS. 4 and 5 illustrate the course of two successive binder warps 4. FIG. 6 on the other hand, shows the course of one binder weft 5.

Figure 7:
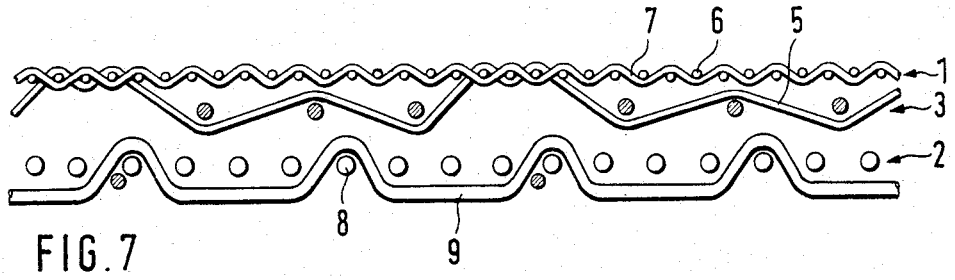
FIGS. 7 to 10 show a composite fabric in which a number of the weft threads of the interlayer are interwoven neither with the lower nor with the upper layer.
Figure 8:
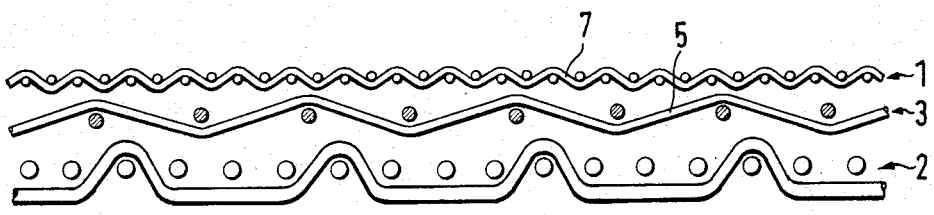
Figure 9:
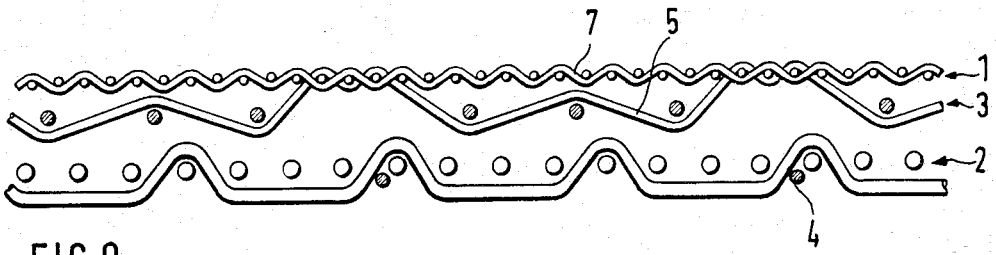
Figure 10:
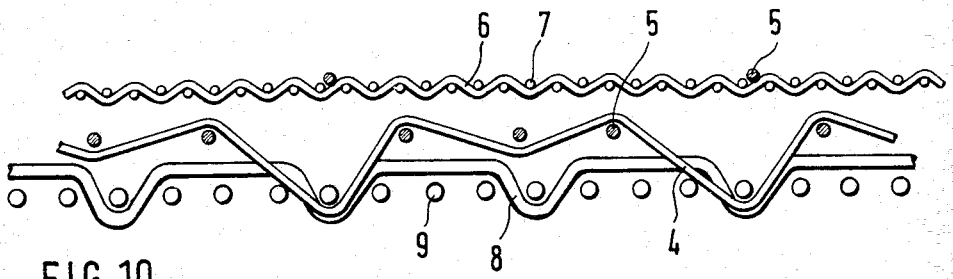

In the embodiment illustrated in FIGS. 7 to 10 only every second binder weft 5 is interwoven with the upper layer 1, while the binder weft 5 therebetween is interwoven with none of the two layers 1, 2 and only participates in the formation of the interlayer 3, as shown in FIG. 8. FIGS. 7, 8 and 9 represent sections parallel to the weft direction, while FIG. 10 is a section parallel to the warp direction and consequently shows the course of the binder warp 4. Owing to the fact that only every second binder weft 5 is actually interwoven with the upper layer 1, one obtains a very loose, elastic interconnection between the two layers 1, 2.

Figure 11:
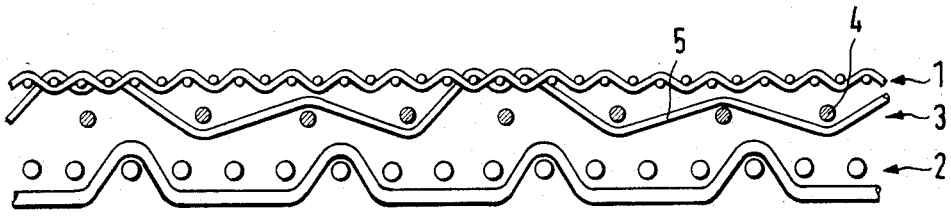
FIGS. 11 and 12 show a composite fabric in which the warp threads of the interlayer are interwoven neither with the upper layer nor with the lower layer.
Figure 12:
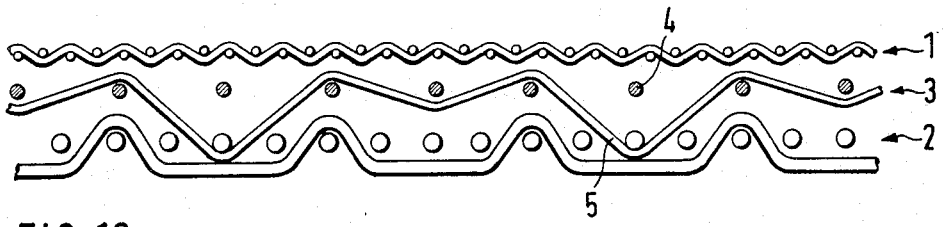

FIGS. 11 and 12 show a section parallel to the weft threads of a further embodiment of the invention. In this case, the binder weft 5 is alternately interwoven with the upper layer 1 (FIG. 11) and with the lower layer 2 (FIG. 12), while the binder warp 4 is interwoven with none of the two layers 1, 2 and only participates in the formation of the interlayer 3. By this mode of interconnection of the layers, tension and distortion in the warp direction are not transmitted from the lower layer 2 to the upper layer 1.

EXAMPLE

The upper fabric layer 1 of a composite fabric composed of two fabric layers is woven flat with 32 longitudinal threads (warp) per centimeter and 36 transverse threads (weft) per centimeter in plain weave. The longitudinal threads 6 have a diameter of 0.17 mm and are formed of polyester monofilament of medium to lesser longitudinal stability and medium elastic modulus (Trevira 930). The transverse threads 7 likewise have a diameter of 0.17 mm and consist of polyester monofilament of very low elastic modulus and low thermal shrinkage (Trevira 900).

The lower fabric layer 2 is a four-harness, No. 0401 weave twill with long floats of the transverse threads on the backing side and short floats on the upper side. The lower fabric layer 2, having 16 longitudinal threads per centimeter and 18 transverse threads per centimeter, is woven flat simultaneously with the upper layer 1. The longitudinal threads 8 have a diameter of 0.32 mm and consist of polyester monofilament of high elastic modulus. The transverse threads 9 of the lower fabric layer 2 are made of especially wear-resistant material and are made alternately of polyester monofilament and polyamide monofilament having a diameter of 0.35 mm.

The active external fabric layers 1 and 2 are interconnected by an elastic tension-compensating interlayer 3. Only the weft wires of the interlayer 3 are interwoven with the upper fabric layer 1 (FIGS. 7 and 9) in such a way that the binder weft wires are interwoven with three successive warp wires 6 of the upper fabric layer. Additional binder weft wires 5 of the interlayer 3 are not interwoven with the upper fabric layer 1 and merely run within the interlayer 3. The binder weft wires 5 interwoven with the upper fabric layer 1 (FIGS. 7 and 9) may consist of monofilamentary or multifilamentary plastic thread made from polyester or polyamide. In the present example a polyester monofilament of 0.15 mm diameter and low elastic modulus is employed. The binder weft wires 5 woven only within the interlayer 3 (FIG. 8) suitably comprise monofilaments of medium to high elastic modulus and likewise of 0.15 mm diameter.

The binder warp wires 4 of the interlayer 3 may comprise monofilamentary or multifilamentary polyester or polyamide threads. In the present example monofilamentary 0.18 mm diameter polyester threads were used. The binder warp wires 4 are interwoven only with the lower fabric layer 2.

In all cases, it is understood that the above-identified arrangements are merely illustrative of the many possible specific embodiments which represent applications of the present invention. Numerous and varied other arrangements can readily be devised in accordance with the principles of the present invention without departing from the spirit and scope of the invention.

What is claimed is

1. A composite fabric for use as clothing for the sheet forming section of a papermaking machine, said fabric comprising at least two fabric layers interconnected by binder threads and being characterized in that part of the binder threads extend in the warp direction and part of said threads extend in the weft direction and said threads form an elastic interlayer, and in that each binder thread is woven into not more than one of the at least two fabric layers.

2. A composite fabric according to claim 1 further characterized in that the binder threads woven into an upper fabric layer are passed underneath all the binder threads woven into a lower fabric layer.

3. A composite fabric according to claim 1 further characterized in that the binder threads extending in the warp direction and the binder threads extending in the weft direction are interwoven with one another.

4. A composite fabric according to claim 3 further characterized in that the binder threads extending in the warp direction are woven partially into an upper fabric layer and partially into a lower fabric layer, while the binder threads extending in the weft direction are only interwoven with the binder threads extending in the warp direction.

5. A composite fabric according to claim 3 further characterized in that the binder threads extending in the weft direction are partially woven into an upper fabric layer and partially into a lower fabric lawyer, while the binder threads extending in the warp direction are only interwoven with the binder threads extending in the weft direction.

6. A composite fabric according to claim 1 further characterized in that the binder threads extending in the warp direction are woven into one fabric layer, and the binder threads extending in the weft direction are woven into another fabric layer.

7. A composite fabric according to claim 6 further characterized in that the binder threads woven into an upper fabric layer are passed underneath all the binder threads woven into a lower fabric layer.

8. A composite fabric according to claim 6 further characterized in that the binder threads extending in the warp direction and the binder threads extending in the weft direction are interwoven with one another.

9. A composite fabric according to claim 1 further characterized in that the binder threads are interwoven with a plurality of threads of said fabric layers, said threads of said fabric layers extending in one of the warp and weft directions.

* * * * *